United States Patent [19]

Williams et al.

[11] 4,282,685

[45] Aug. 11, 1981

[54] QUICK OPENING WINDOW FOR TRAILERS AND MOBILE HOMES

[76] Inventors: Brian Williams, 545 7th St., Struthers, Ohio 44471; Richard Kratsas, 1408 E. Florida Ave., Youngstown, Ohio 44502

[21] Appl. No.: 81,474

[22] Filed: Oct. 3, 1979

[51] Int. Cl.[3] ..... E05C 15/02

[52] U.S. Cl. ..... 49/141; 49/374

[58] Field of Search ..... 49/141, 374, 377, 378; 105/348

[56] References Cited

U.S. PATENT DOCUMENTS

| | | | |
|---|---|---|---|
| 900,407 | 10/1908 | Mende | 105/348 |
| 1,266,690 | 5/1918 | Kostudowicz | 49/374 |
| 1,935,887 | 11/1933 | Murphy | 49/374 X |
| 4,106,236 | 8/1978 | Oliphant | 49/141 |

FOREIGN PATENT DOCUMENTS

| | | | |
|---|---|---|---|
| 15956 | of 1913 | United Kingdom | 49/141 |

*Primary Examiner*—Philip C. Kannan

*Attorney, Agent, or Firm*—Webster B. Harpman

[57] ABSTRACT

A quick opening window positions a glazed sash in a window opening in weather sealing relation and supports said glazed sash in closed relation to the opening on a sidewardly slidable support which is moved from its normal position beneath the glazed sash to permit the sash to drop into a hollow cavity beneath the window opening. A tension latch arrangement is provided which must be overcome in moving the glazed sash support from its normal position to prevent the accidental opening of the window.

3 Claims, 4 Drawing Figures

QUICK OPENING WINDOW FOR TRAILERS AND MOBILE HOMES

BACKGROUND OF THE INVENTION (1) Field of the Invention

This invention relates to quick opening windows such as may be employed to provide a safety exit from an enclosure such as a trailer or mobile home.

(2) Description of the Prior Art

Prior structures of this type are best illustrated in U.S. Pat. Nos. 900,407 and 4,106,236.

In U.S. Pat. No. 900,407 the glazed sash is normally supported on a flexible strap and means is provided for holding the strap in predetermined location. Detaching the strap and lowering the window achieves the essential purpose. No particular weather sealing construction or positive support for the glazed window sash is suggested by the patent.

The U.S. Pat. No. 4,106,236 patent discloses a fire door for a trailer with a quick operating latch which serves to hold a door in fixed position in an opening in a wall. Rotational movement of the latch frees the upper portion of the door which may then be moved outwardly of the opening to provide a suitable exit.

The present invention features a compact relatively small support structure which can be built into a hollow wall of a trailer or mobile home beneath and in communication with a window opening therein and arranged to support a glazed sash in normal closed relation in the window opening. A handle on the inside of the trailer or mobile home provides means for moving the support structure sufficiently to permit the glazed sash to drop downwardly by gravity into the cavity in the wall of the trailer or mobile home to form a safety exit.

The glazed sash itself is frictionally engaged in a conforming channel configuration in the window opening so that it can be moved upwardly to closed position and the support means repositioned thereinunder.

SUMMARY OF THE INVENTION

A quick opening window for trailers and mobile homes comprises a glazed sash movably disposed in a frame defining a window opening in a wall of the trailer or mobile home with a cavity in the wall beneath the window opening of a size and shape sufficient to receive the glazed sash when lowered thereinto. A movable support platform in the lowermost portion of the window opening and beneath the normal frame thereof normally supports the glazed sash in weather-tight relation and means is provided on the interior of the trailer or mobile home for moving the support means relative to its supporting position to permit the glazed shape to drop downwardly into the cavity below the window opening so as to form a safety exit.

DESCRIPTION OF THE PREFERRED EMBODIMENT

Figure 1:
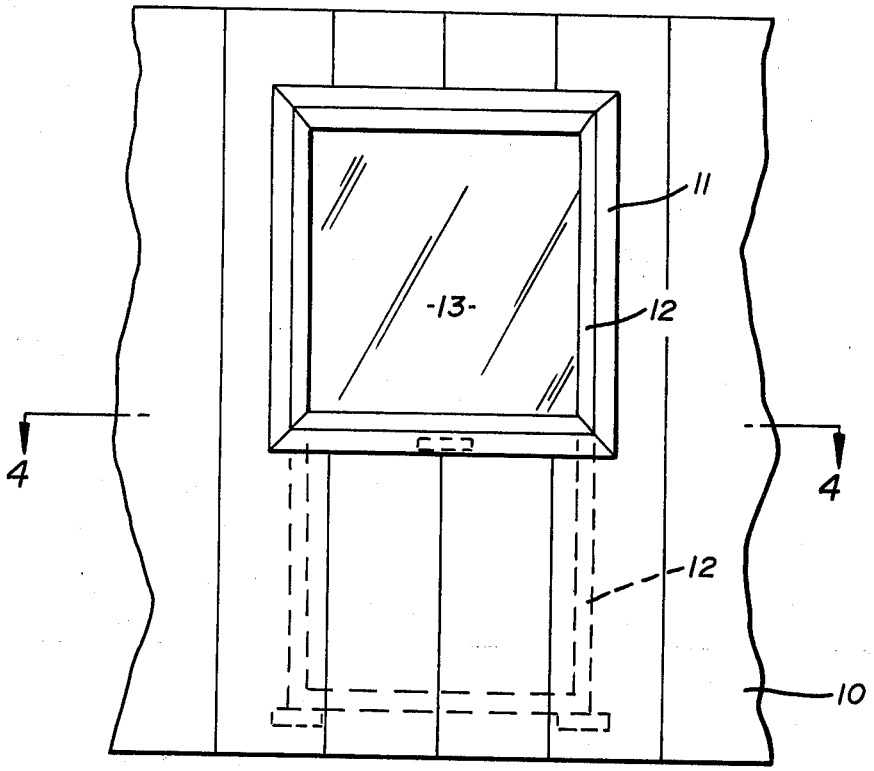
FIG. 1 is a side view of a portion of an exterior wall of a mobile home showing the quick opening window installed therein.

In the form of the invention chosen for illustration and description herein, the quick opening window for trailers and mobile homes may be seen in side elevation in FIG. 1 of the drawings, wherein a side 10 of a trailer or mobile home is illustrated and a window opening therein is defined by a rectangular frame 11. A sash 12 having transparent glazing material such as glass or optical grade plastic 13 is secured in the sash 12 as will be understood by those skilled in the art and broken lines in FIG. 1 indicate a lower alternate or open position of the sash 12 in a cavity beneath the window opening defined by the frame 11.

Figure 2:
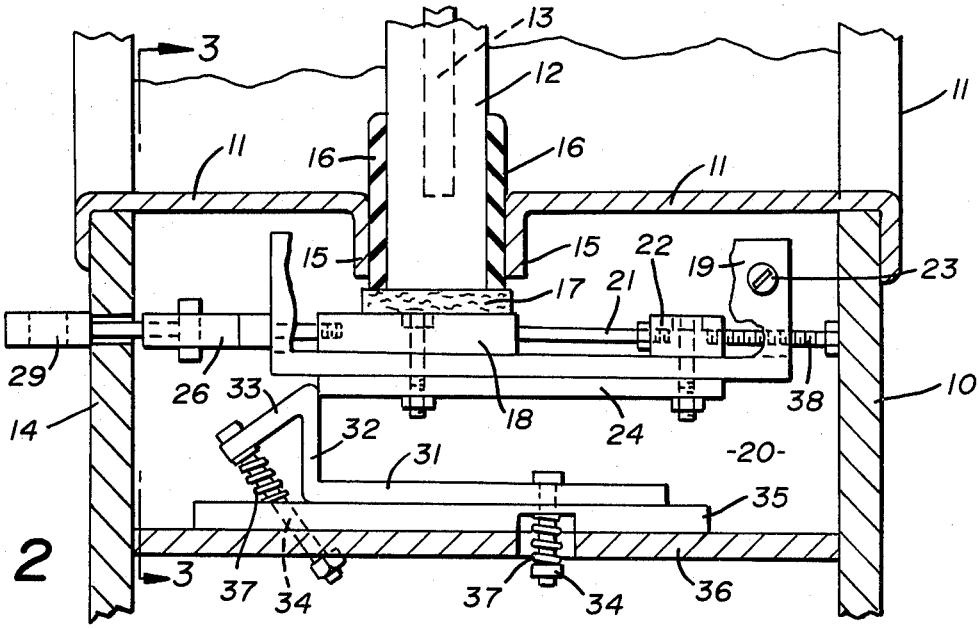
FIG. 2 is a cross sectional elevation of the quick opening window and on an enlarged scale.

By referring now to FIG. 2 of the drawings, it will be seen that the glazed sash 12 is positioned between the outer wall 10 of the trailer or mobile home and an inner wall 14 by the frame 11 which is preferably flanged at its inner ends at 15 which position a pair of oppositely disposed resilient gaskets 16 which directly engage the sides of the sash 12.

Still referring to FIG. 2 of the drawings, it will be seen that the sash 12 is directly supported on a resilient strip 17 which is positioned longitudinally of the upper surface of a support bar 18 which extends longitudinally below the sash 12 and has its end portions slidably engaged on the horizontal portions of angle members 19 which are in turn secured to frame members 20 which extend between the inner and outer walls 10 and 14 of the trailer or mobile home as the case may be. The support bar 18 has a pair of sidewardly extending rods 21 on its opposite ends which rods engage a secondary support bar 22 which is positioned in spaced parallel relation to the support bar 18.

The angle members 19 are preferably attached to the frame members 20 by means of fasteners 23.

Plates 24 are positioned partially beneath the lower surfaces of the horizontal sections of the angle members 19 and held in spaced relation to the support bars 18 and 22 by fasteners 25.

Figure 3:
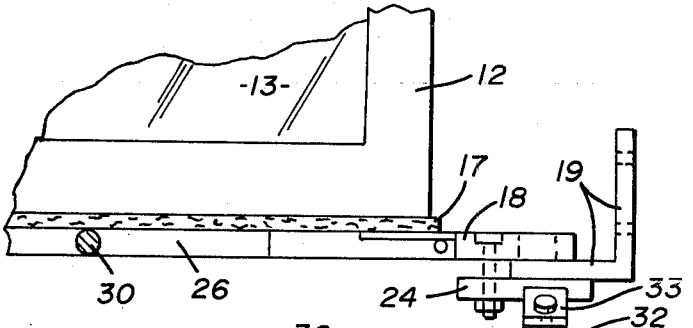
FIG. 3 is a cross sectional detail on line 3—3 of FIG. 2 with parts broken away and parts in cross section.
Figure 4:
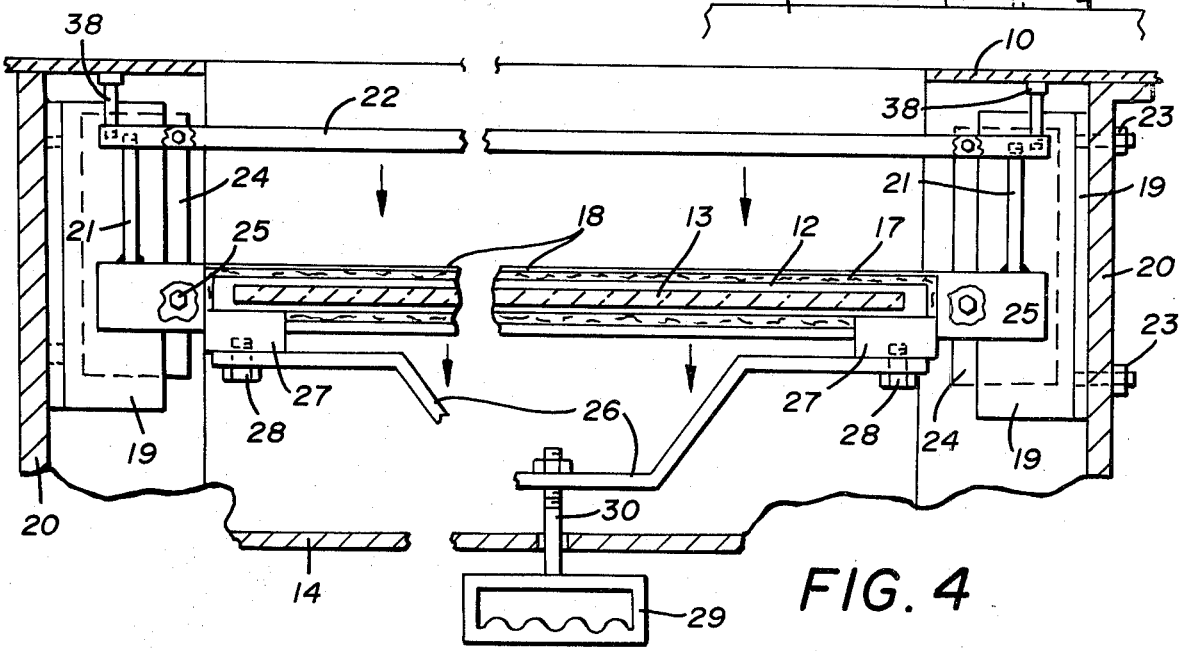
FIG. 4 is a horizontal section in enlarged detail on line 4—4 of FIG. 1.

By referring now to FIG. 4 in particular, it will be observed that the space between the support bar 18 and the secondary support bar 22 is more than sufficient to permit the glazed sash 12 to move downwardly therebetween at such time as the support bar 18 and the secondary support bar 22 are moved as indicated by the arrows in FIG. 4 of the drawings. In order that such movement may be imparted to the support bar 18 and the secondary support bar 22 so as to move the support bar 18 out from under the glazed sash 12, an angular bracket 26 is attached to the support bar 18 by means of brackets 27 and fasteners 28 respectively. A handle 29 is positioned on the opposite side of the inner walls 14 of the trailer or mobile home construction as heretofore described and is connected by a connecting bar 30 with the angular bracket 26. Movement of the handle 29 will not immediately move the support bar 28 relative to its supporting position beneath the glazed sash 12 until the tension of a friction catch is overcome. The friction catch may best be seen in FIGS. 2 and 3 of the drawings, and by referring thereto it will be seen that a catch device comprises a horizontally disposed body member 31 having a vertical end portion 32 with an outwardly and downwardly inclined angular extension 33. A pair of bolts 34 loosely attach the member 31 to a support base 35 and it in turn is attached to a cross frame member 36 in the wall of the trailer or mobile home. The bolts 34 are both loosely positioned and held in tensioned relation as shown by coil springs 37, the arrangement being such that movement imparted the handle 29 so as to move the support bar 18 from its supporting position relative to the glazed sash 12 must tilt the latch members 31 and 32 and the angular end portion 33 in both instances compressing the coil springs 37 about the loosely positioned bolts 34.

The vertical portion 32 of the latch means will directly engage the end of one of the plates 24 as seen in FIGS. 2 and 3 of the drawings, and motion imparted the handle 29 must therefore overcome the resistance of the springs 37 and permit the latch members 31 32, and 33 to move to permit the plates 24 to slide along with the support bar 18 toward the inner wall 14 of the wall of the trailer or mobile home in which the safety window is installed.

The arrangement is such that when the safety window is to be replaced in closed position in the opening defined by the frame 12, it may be elevated to the position shown in FIGS. 1 and 2 of the drawings and the slide bar 18 repositioned therebeneath where it will again assume a latched and relatively fixed position by reason of the latching device and the parts 32 and 33 thereof in particular.

Those skilled in the art will observe that the frame member 11 while shown in two portions in FIG. 2 of the drawings may comprise a single extruded or stamped aluminum shape or the like with a channel which engages the sides and uppermost portion of the glazed sash 12 with the web of the channel cutaway in the portion of the frame 11 as seen in FIG. 2 of the drawings where the glazed sash 12 will move downwardly when the support bar 18 is withdrawn from its normal support position as hereinbefore explained.

Adjustable stop means to control the travel of the support bar 18 and the secondary support bar 22 are preferably included in the device and are illustrated in FIGS. 2 and 4 of the drawings and indicated by the numerals 38 and a similar adjustment is provided by the movable engagement of the connecting bar 30 with the angular bracket 26 as hereinbefore described.

It will thus be seen that a quick opening window for trailers and mobile homes has been disclosed which may be relatively easily and inexpensively formed and assembled as a unit in a wall cavity immediately beneath a window opening in the wall so as to normally position a glazed sash therein in sealing relation to the wall and yet be movable quickly and easily to permit the glazed sash to drop completely out of the window opening and into a cavity of the wall therebeneath so as to provide a readily accessible usable safety exit from the trailer or mobile home, the construction being such that the glazed sash may be easily repositioned in sealing relation to the window opening and the support means repositioned where it is held against accidental disengagement as necessary in a trailer or mobile home.

Although but one embodiment of the present invention has been illustrated and described, it will be apparent to those skilled in the art that various changes and modifications may be made therein without departing from the spirit of the invention and having thus described our invention what we claim is:

1. A quick opening window for trailer and mobile home walls in which a window opening in one of said walls is defined by a frame, the frame having a longitudinally extending slot therein communicating with a cavity in said wall below said window opening, a glazed sash movably positioned in said frame in said window opening in registry with said longitudinal slot, a support bar in said cavity beneath said glazed sash normally supporting said glazed sash in said frame, members having horizontally disposed surfaces receiving the end portions of said support bar in movable relation to said glazed sash and wherein a secondary support bar is attached to said support bar in spaced parallel relation thereto so that the area between said support bar and said secondary support bar defines an opening through which said glazed sash may move into said cavity and out of said window opening.

2. The quick opening window of claim 1 wherein plates are secured to said support bar at its opposite ends in spaced relation therewith and underlying said support members so as to stabilize said support bar when moved from under said glazed sash.

3. The quick opening window of claim 1 wherein at least one friction catch device is in said cavity in said wall engaging said plates so as to restrain the same against accidental movement.

* * * * *